US006308551B1

(12) United States Patent
Park

(10) Patent No.: US 6,308,551 B1
(45) Date of Patent: Oct. 30, 2001

(54) APPARATUS FOR BENDING CUTTING BLADE

(76) Inventor: Hong Soon Park, 91 Pungmoo-dong, Kimpo-shi, Kyoungki-do, 415-070 (KR)

( * ) Notice: Subject to any disclaimer, the term of this patent is extended or adjusted under 35 U.S.C. 154(b) by 0 days.

(21) Appl. No.: 09/614,613

(22) Filed: Jul. 12, 2000

(30) Foreign Application Priority Data

May 25, 2000 (KR) ..... 00-28313

(51) Int. Cl.[7] ..... B21D 5/04
(52) U.S. Cl. ..... 72/307; 72/217; 72/388
(58) Field of Search ..... 72/307, 388, 387, 72/319, 217, 216

(56) References Cited

U.S. PATENT DOCUMENTS 4,718,265 * 1/1988 Post ..... 72/217
5,870,919 * 2/1999 Song ..... 72/319
5,881,591 * 3/1999 Ondracek ..... 72/307
5,966,974 * 10/1999 Song ..... 72/307
6,003,368 * 12/1999 Lipari ..... 72/307
6,128,940 * 10/2000 Song ..... 72/307

* cited by examiner

*Primary Examiner*—Daniel C. Crane
(74) *Attorney, Agent, or Firm*—Cobrin & Gittes

(57) ABSTRACT

An apparatus for bending a cutting blade rule includes: a guide having a guide passage formed therein for transferring said cutting blade rule in a lengthwise direction; a first rotary body located at an upper position adjacently to a head of said guide; a second rotary body located at a lower position adjacently to a head of said guide and oppositely to said upper position; a first bending member supported by a hole formed on said first rotary body; a second bending member supported by a hole formed on said second rotary body, said second bending member being opposite to said first bending member in a substantial perpendicular direction to said lengthwise direction; a drive means for driving said first and second rotary bodies; and linear drive means for linearly moving said first and second bending members respectively. Accordingly, independent forces can be applied to each upper and lower portions of the cutting blade rule, which forces are adjusted based upon predetermined sizes of the cutting blade such as height and thickness and in particular physical property thereof, thereby eliminating or minimizing drawbacks caused by spring back effects and forming the cutting blade into desirable precise profiles.

18 Claims, 10 Drawing Sheets

(a)

(b)

APPARATUS FOR BENDING CUTTING BLADE

BACKGROUND OF THE INVENTION

The present invention relates to an apparatus for bending a cutting blade, and more particularly to an apparatus for mechanically bending a cutting blade into a predetermined profile by the use of rotating bending members.

The most conventional and well-known traditional method to bend a cutting blade may be the skill of manually punching the blade for imparting appropriate curves thereto. The advent of automatic processing has also influenced on the fields to which the present invention pertains so that various types of automatic bending machines have been developed, the typical one being shown in FIG. 12.

As it can be seen from FIG. 12, GB 2,116,086 discloses an apparatus in which a rotating pin 70, which is placed in front of a guide 64, folds or bends a rule whose advance forward is guided by the guide 64, the pin 70 being eccentrically planted in a spindle 68. Rotating movement of the spindle 68 makes the pin 70 rotate or revolve around its center until the pin 70 contacts and exerts lateral force on the rule, and such inflicted force is also focused on the head part of the guide 64. Accordingly, the rule portion between the pin 70 and the head of the guide 64 finally bends, its bending angle naturally depending upon the net rotated angle of the pin 70.

Another prior art is disclosed in U.S. Pat. No. 5,870,919, which is substantially identical to the above apparatus, the differences being that it adopts two folders and two rotary bodies that act as spindles. According to this invention, one folder assumes bend of, for example, left side of the rule, and the other right side of the rule.

There have been also attempts for bending various cutting blades having different width with a single bending machine. For instance the apparatus of Japanese Unexamined Patent Publication No. Hei10-286,625 places on a platform a plurality of folders with different width, and, in the bending processing, selects a suitable one based upon the width of the cutting blade to be bent which affords to provide the most proper bending force. However, despite of the merit of wider applications, this invention does not consider the most important physical property of the cutting blade likewise other prior arts.

That is, as illustrated in FIG. 9, a conventional cutting blade A consists of a body portion A' and a blade portion A" formed upwards on the body portion A' to shape a triangle with a pointed acute tip or blade. In order to sustain persistent cutting ability, the blade portion A' that directly engages with a blank to be cut should be made to have higher rigidity, stiffness and toughness, so that the blade portion A' is subject to more intensive heat treatment compared to the body portion A'. Accordingly, the physical properties of these two portions are different from each other, which results in different behaviors under spring back. Once a cutting blade is bent, the blade portion A" having relatively higher elasticity due to intensive heat treatment, is subject to stronger spring back effects so that it shows more tendency of returning back to its original position. Its final horizontal bending angle becomes smaller than that of the body portion A'.

Practical problems arise from the fact that the spring back behavior of the blade portion A" is extended onto a considerable upper area of the body portion A', there being found many cases in which nearly half the upper area of the body portion A' shows the same behavior as that of the blade portion A". This is because a strong resilient force by spring back acting on the blade portion A" is also transferred to the upper body portion beyond a borderline between the two portions A', A". Further, high temperature effects at the blade portion A" under intensive heat treatment are also delivered to a considerable region of the body portion A' so that it cannot be avoided that the upper part shows stronger rigidity and resilience than the lower part of the body portion A'. Residual torsion and deformation are found in the thus formed cutting blade, and the final bending angle of the upper part of the cutting blade A including blade portion A' becomes smaller than that of the remaining lower part. One can easily find these drawbacks when making a minute and small cutting blade for fabricating complicated and small articles calling much demand nowadays.

Therefore, it is a primary object of the present invention an apparatus is provided for a cutting blade that can form an accurate vertical profile and a uniform bending angle without any deformation or torsion even under spring back phenomenon.

Next, the height of each cutting blade is different depending upon the blank to be cut, ranging from some millimeters to centimeters. It is natural that a folder cannot bend a taller cutting blade. To the contrary, using a folder much taller than a cutting blade entails a problem that strong and uniform lateral force is difficult to be exerted on all the contacting areas between the cutting blade and the folder, and to use a thick folder to solve this problem again gives rise problems of not providing minute and accurate bends.

An apparatus is provided for a cutting blade that can provide strong and uniform lateral force on the cutting blade without changing the entire apparatus.

The present invention basically includes a guide having a guide passage formed therein for transferring the cutting blade in a lengthwise direction, a first rotary body located at an upper position adjacently to a head of the guide, a second rotary body located at a lower position adjacently to the head of the guide and opposite to the above upper position, a first bending member supported by a hole formed on the first rotary body, a second bending member supported by a hole formed on the second rotary body, the second bending member being oppositely located to the first bending member in a substantial perpendicular direction to the above lengthwise direction (hereinafter referred to as "vertical direction" throughout the specification), a drive means for driving the first and second rotary bodies, and linear drive means for linearly moving the respective first and second bending members in a vertical direction.

According to the above features of the present invention, since it is possible to adjust relative positions of the first and the second bending members, independent forces can be applied to each upper and lower portions of the cutting blade, which forces are adjusted based upon predetermined sizes of the cutting blade such as height and thickness and in particular physical property thereof, thereby eliminating or minimizing drawbacks caused by spring back effects and forming the cutting blade into desirable precise profiles. It should be noted that prior arts have simply had a bending member rotate further than final bending angle to compensate for spring back, and never noticed that the upper portion and lower portion of the rule differently respond to this situation.

Further, the present invention is characterized in that the first bending member is spaced by a small distance from the second bending member towards the guide in a lengthwise direction. This can be done by either having the first rotary body and the first bending member supported thereby move towards the head of the guide by the use of a movable setting means for the first rotary body, or having the second rotary body and the second bending member supported thereby move towards opposite direction to the head of the guide by the use of a movable setting means for the second rotary body.

According to this feature of the present invention, when drive means rotate at a predetermined speed, the first rotary body which is set to be placed more closely to the drive means has more rotary number than the second rotary body, accordingly, net rotated angle of the first bending member becomes larger than that of the second bending member, leading to a larger curve or bending at the upper portion of the cutting blade. However, once the cutting blade is subject to spring back, as sprung back or withdrawn angle at the upper portion is larger than that at the lower portion, as is explained above, this completely absorbs the initial bending difference of the upper portion from the lower portion, and thus made cutting blade provides accurate vertical profiles and uniform horizontal bending angle without deformation or torsion.

Further, the present invention is characterized in that each movable setting means accommodating each first and the second rotary body is moved by a small distance in a lengthwise direction by the control of distance adjusting bolts affixed thereto.

Thus, it is possible to easily and minutely adjust the position of each rotary body held by the movable setting means by controlling the distance adjusting bolts.

Further, the present invention has the first rotary body and the second rotary body be connected to the drive means via belts.

Thus, if the rotary body moves towards or away from the head of the guide, the distance gap caused by movement of the rotary body can be completely absorbed by the resilient and elastic belt without affecting on tight and smooth power transmission from the drive means to the rotary body.

Further, the present invention is characterized in that the first rotary body and/or the second rotary body includes an upper radial portion which is directly connected to the drive means, a lower radial portion integrally formed with and protruding from the upper radial portion, and a bending member guide having the hole formed therein, and protruding outwards from the lower radial portion.

Further, the present invention is characterized in that the length of the first and second bending members engaging with the cutting blade can be adjusted in a vertical direction.

According to this feature of the present invention, especially when bending a short and thick cutting blade, it is possible to exert uniform and strong force on the cutting blade by adjusting the projected part of the bending members into the working region in a vertical direction, so more accurate bending can be effectively achieved.

Further, the present invention is characterized in that the bending member guide is exchangeable. The bending member guide is preferably fixed to a holder which is again fixed to the side or bottom portion of the second radial portion of the rotary body.

According to this feature of the present invention, it is possible to bend cutting blades of various height with a single apparatus by changing the bending member guide, requiring no alteration or change of the bending member as well as the entire machine. Thus, merits of high productivity and low cost are expected.

BRIEF DESCRIPTION OF THE DRAWINGS

The present invention will become better understood with reference to the accompanying drawings which are given only by way of illustration and thus are not limitative of the present invention, wherein:

FIG. 10(*b*) is a lower side view illustrating a bending member guide and a bending member that are composed in units in accordance with the present invention;

FIG. 11(*b*) is a side view of FIG. 10(*a*); and

DETAILED DESCRIPTION OF THE PREFERRED EMBODIMENTS

Figure 1:
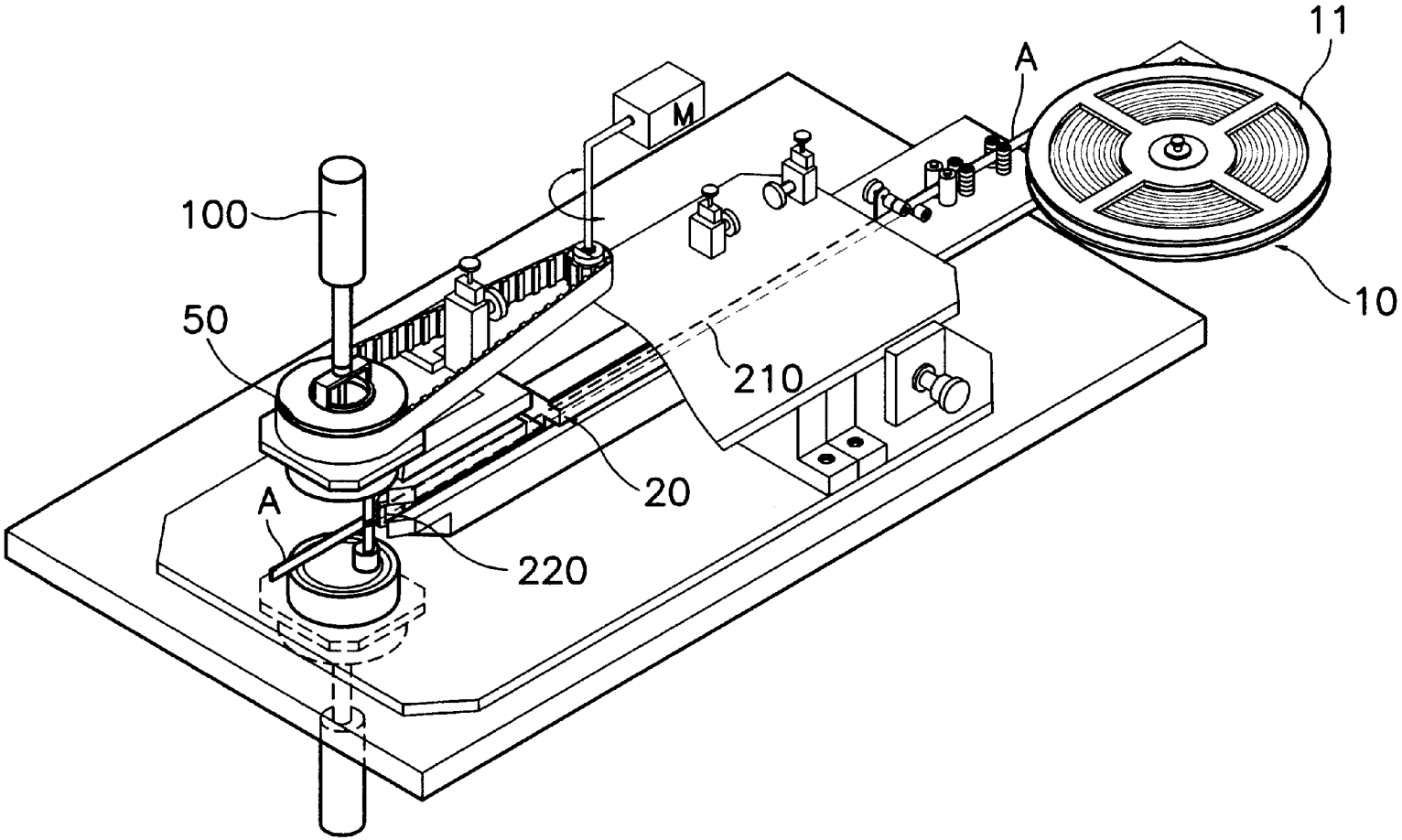
FIG. 1 is a perspective view illustrating an automated whole bending system incorporating a bending apparatus for a cutting blade in accordance with the present invention.
Figure 2:
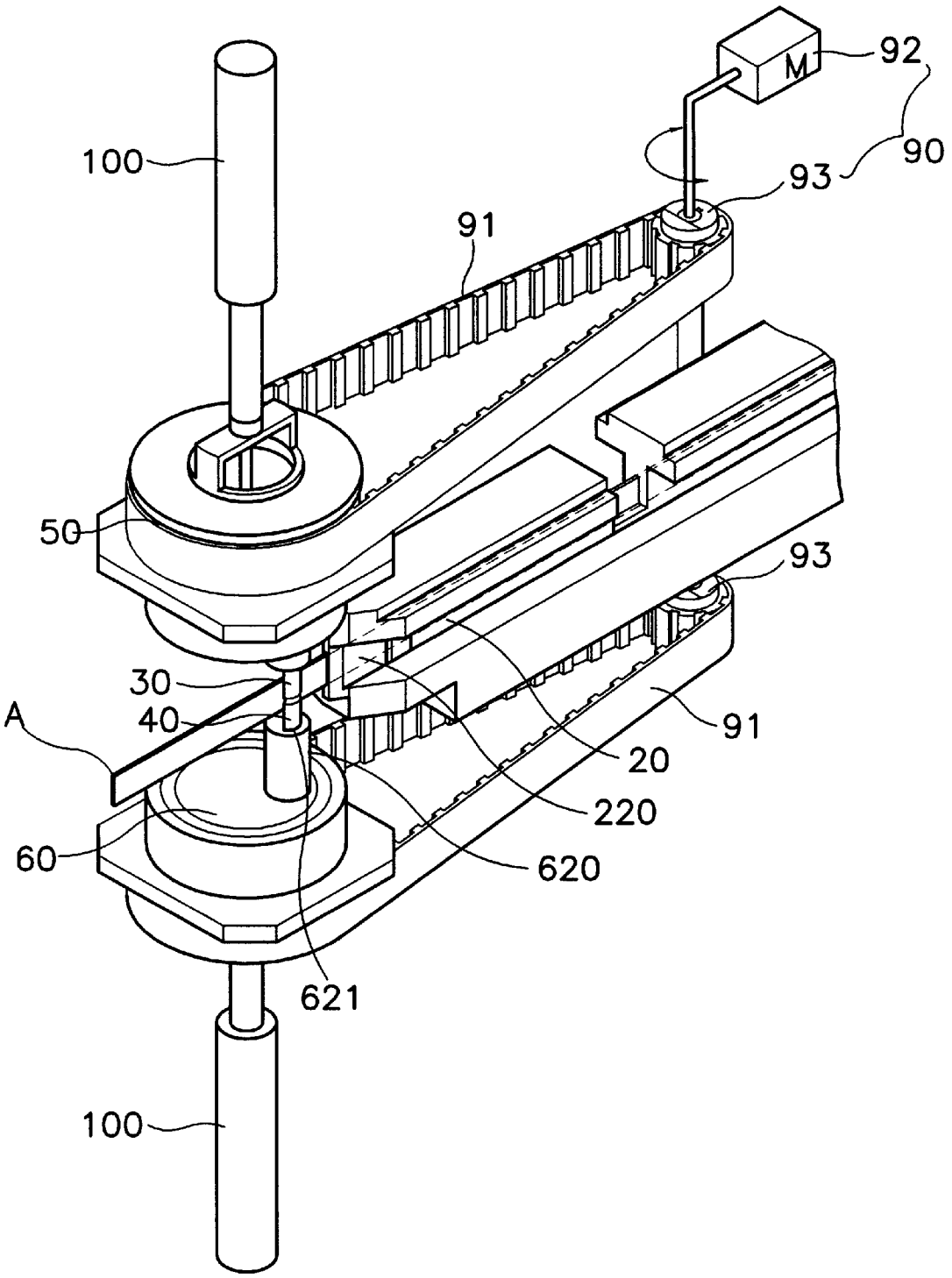
FIG. 2 is a perspective view illustrating a detailed construction of the bending apparatus in accordance with the present invention.

FIG. 1 illustrates an automated whole bending system incorporating a bending apparatus for a cutting blade in accordance with the present invention, which is illustrated in more detail in FIG. 2. In FIG. 1, the automated system includes a cutting blade supply unit 10 for unwinding a cutting blade A from a reel 11, and supplying the cutting blade A to a guide 20 where a guide passage 210 for the cutting blade A is formed.

The guide 20 is positioned in front of the cutting blade supply unit 10. The guide passage 210 for guiding the cutting blade A is centrally formed through the entire length of the guide 20 in a lengthwise direction. A head 220 of the guide 20 serves as an exit through which the cutting blade A is released into the working region for bending, and also serves as a support member when the cutting blade is bent. The head 220 may be formed integrally with the guide 20, however, it is preferable that the head 220 is formed as a separate unit so as to be replaceable pursuant to a width of the cutting blades of various types, as illustrated in the drawings.

As illustrated in FIG. 2, an upper rotary body 50 as a first rotary body is arranged over the head 220 of the guide 20, and a lower rotary body 60 as a second rotary body is arranged under the head 220 of the guide 20.

Figure 3:
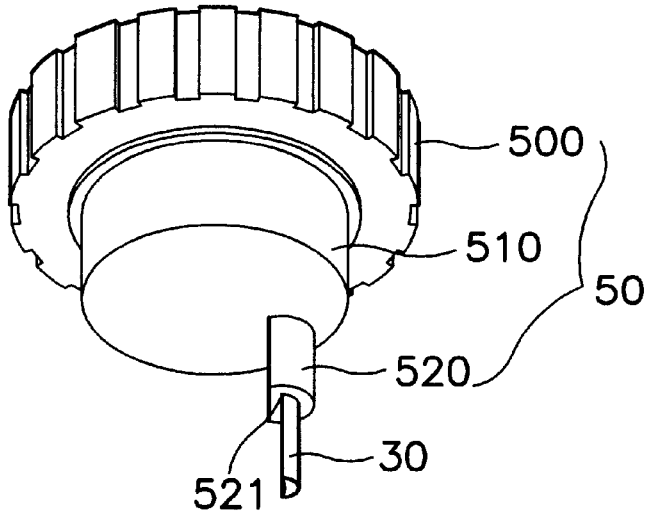
FIG. 3 is a lower perspective view illustrating a structure of a rotary body of the bending apparatus in accordance with the present invention.

The detailed constructions of the upper and lower rotary bodies 50, 60 will now be described with reference to FIG. 3. Referring to FIG. 3, the upper rotary body 50 includes: a first radial portion 500 with gears formed on the circumference thereof; a second radial portion 510 having a smaller radius than the first radial portion 500, and being formed in a single body with the first radial portion 500 so as to protrude from the first radial portion 500; and a bending member guide 520 positioned eccentrically from the center of the second radial portion 510, and extended downwardly from the second radial portion 510. A hole 521 for receiving and supporting the bending member is formed throughout the bending member guide 520. The lower rotary body 60 may have the same constitution, and the rotary bodies 50, 60 may be variously modified within the scope of the present invention, for example, the second radial portion 510 can be omitted.

Referring to FIG. 2, the rotary bodies 50, 60 are connected to a drive means 90 including, for example, a pulse motor 92 and power transmission pulleys 93, 93 via belts 91, 91. Accordingly, when the drive means 90 is operated, the upper and lower rotary bodies 50, 60 are rotated via the belts 91, 91, and thus the bending members supported by and received in the rotary bodies are rotated to contact and exert lateral force on the cutting blade A.

A first bending member 30 and a second bending member 40 are respectively inserted into and supported by the holes 521, 621 of the upper and lower rotary bodies 50, 60. The other ends of the bending members 30, 40 are extended through the holes 521, 621 of the rotary bodies, and firmly fixed to link members 102, 102 connected to one ends of operating rods 101, 101 of actuators 100, 100 (refer to FIG. 5). The actuators 100, 100 are means for linearly driving the first bending member 30 and the second bending member 40. Upon activation of the actuators 100, 100, the link members 102, 102 are slid, and thus the bending members 30, 40 are advanced into or retreated from the working region in a vertical direction.

Figure 6:
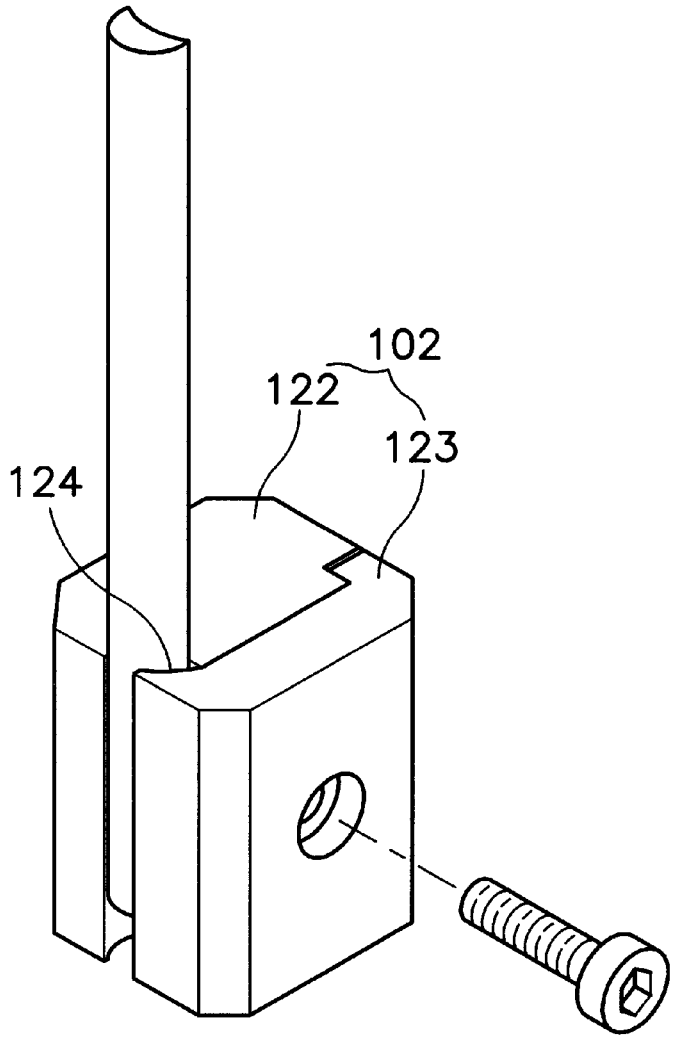
FIG. 6 is a schematic perspective view illustrating a structure of a link member coupled to a bending member.

In FIG. 6, illustrated is a preferable example for adjusting the vertical length of the bending members 30, 40 in accordance with the present invention. Reference numeral 102 denotes a link member 102 comprising a holder 122 and a cover 123 that are coupled by a bolt. The bolt presses lateral side of the bending member that is placed into a gap 124 between the holder 122 and the cover 123, and firmly fixes it so as not to vibrate or slip out of the link member 102. When it is necessary to adjust vertical length of the bending member protruding into the working region, the bolt is loosened, so that the vertical position of the bending member can be adjusted, and again fastened to fix the altered position of the bending member.

In addition, although not illustrated, a cutting unit for cutting the bent cutting blade A is incorporated in front of the bending apparatus according to the present invention.

Thereafter, a first movable setting means 31 according to the present invention will now be described with reference to FIGS. 4 and 5. A second movable setting means may have the same construction, and thus will not be explained. The first movable setting means 31 includes: a radial portion 311 having a hollow center, and engaging with a bearing 522 disposed at the outer circumference of the second radial portion 510 of the upper rotary body 50; and a plate portion 312 as a flange formed integrally with the radial portion 311. Upon fabrication of the bending apparatus, the radial portion 311 is set to have a slight gap from a through hole of an upper plate 70 to which the first movable setting means 31 is fixed, thereby securing a movement margin. Two slide holes 313 are formed at each four sides of the plate portion 312. Thread holes for fastening the plate portion 312 to the upper plate 70 are formed at the upper surface of the plate portion 312, which are omitted in the drawings for clarity.

Figure 4:
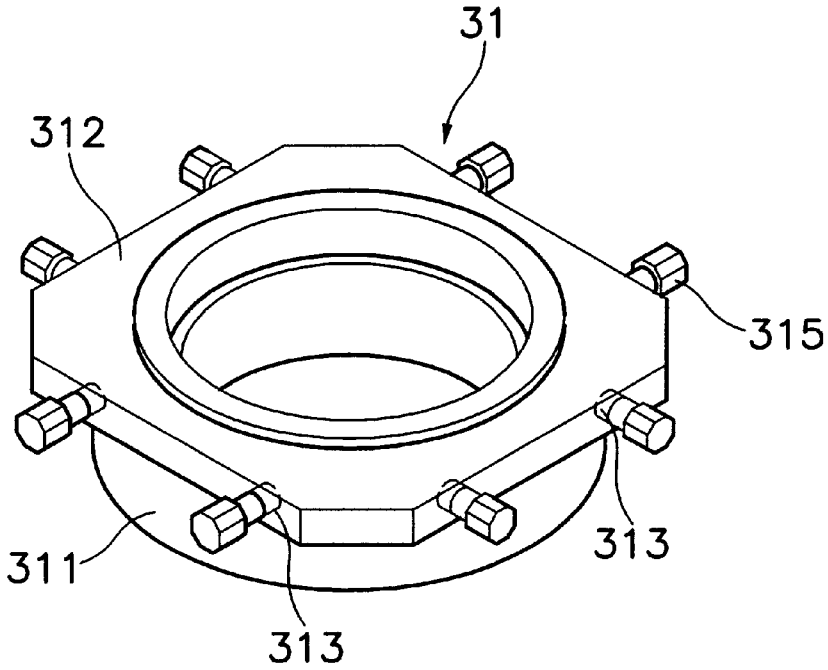
FIG. 4 is a perspective view illustrating a movable setting means in accordance with the present invention.
Figure 5:
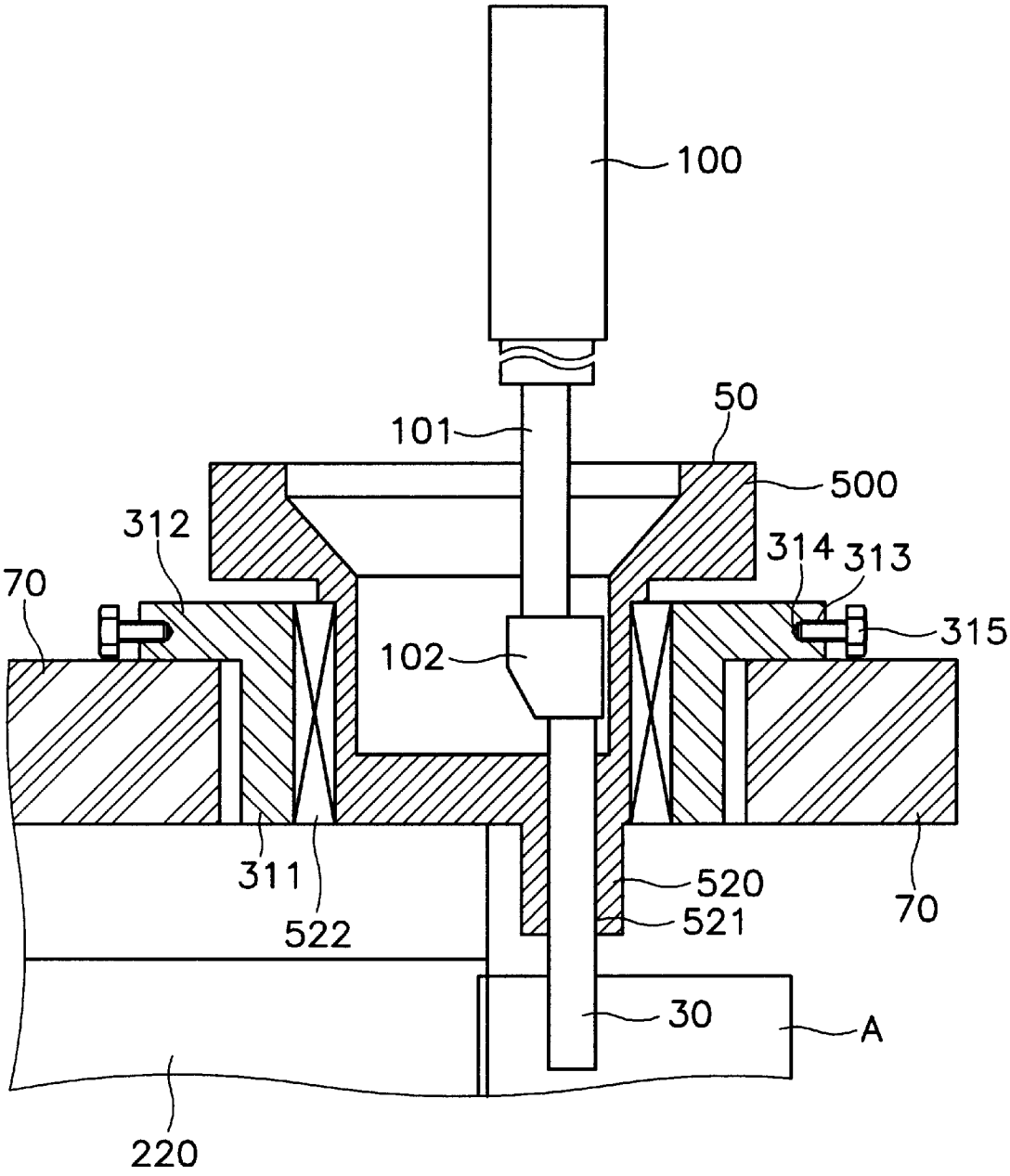
FIG. 5 is an upper cross-sectional view illustrating the bending apparatus incorporating the movable setting means in accordance with the present invention.

As shown in FIGS. 4 and 5, the distance adjusting bolts 315 are inserted into the slide holes 313 of the plate portion 312. Each head of the distance adjusting bolt 315 is set to maintain a slight gap, for example about 1mm from each end 314 of the slide hole 313. Here, the distance adjusting bolt 315 is not immovably fastened to the slide hole 313, and advances to reach into each end 314 of the slide hole 313 by further rotation, thus moving the first movable setting means 31 by a slight distance by continuous thrusting movement. For example, referring to FIG. 5, in order to move the first movable setting means 31 to the left side, namely to the head 220 of the guide 20 in a lengthwise direction, all bolts but those at the right side are loosened and the bolts 315 at the right side are rotated, thereby moving the first movable setting means 31 to the left side correspondingly to the net rotated angle of the bolt 315. Thereafter, the bolts (not shown) are fastened to the thread hole at the upper surface of the plate portion 312 so as to firmly fix the first movable setting means 31 to the upper plate 70. When the first movable setting means 31 is moved, the first rotary body 50 and the first bending member 30 inserted into and supported by the first rotary body 50 are moved together. Accordingly, with the second rotary body 60 being fixed, if the first rotary body 50 is moved to the left side, the first bending member 30 is positioned more adjacently to the head 220 of the guide 20 than the second bending member 40. The maximum movement distance of the first movable setting means 31 does not exceed 5mm under usual working conditions. According to the apparatus in accordance with the present invention which the inventor has developed, the movement distance is set to correspond to exactly 1mm per each rotation of the bolt, being possible to control the distance to the extent below 0.1 mm even in naked eyes.

Figure 10:
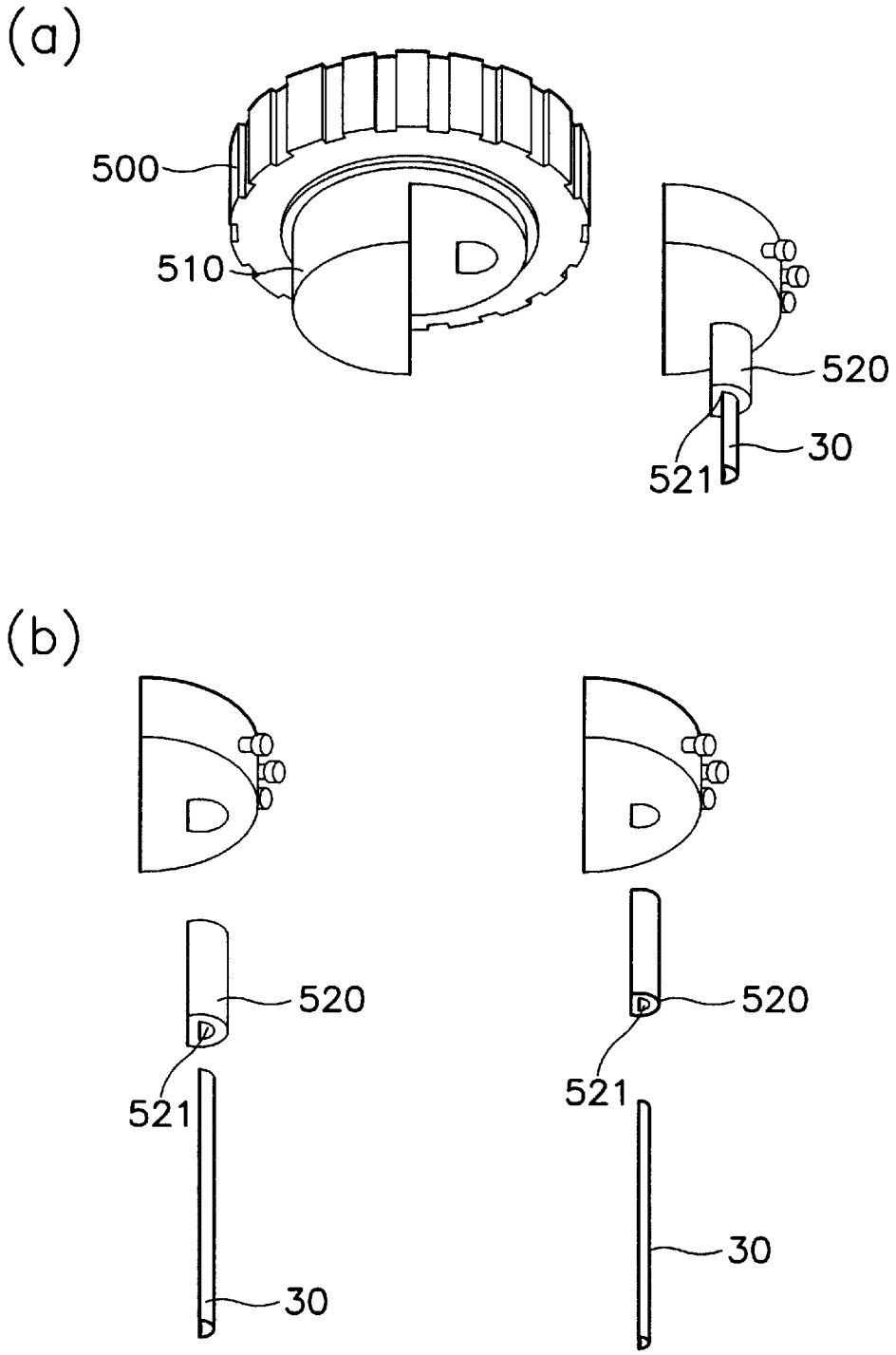
FIG. 10(*a*) is a lower side view illustrating a second example of the rotary body in accordance with the present invention.

Another example of the rotary bodies 50, 60 will now be described in more detail with reference to FIGS. 10(*a*) and 10(*b*). As illustrated therein, the second radial portion 510 is divided into two parts. The separated second radial portion is a holder fastened to the remaining part by bolts. The bending member guide 520 can be preferably fixed into a hole formed in the holder. Otherwise, it is possible for it to be formed integrally with the holder.

According to this construction, bending can be more precisely performed especially when bending a small and thick cutting blade A. That is, when bending a small and thick cutting blade A, to replace the bending member guide 520 at the upper rotary body 50 by the one having a greater length means that the real protruded length of the first bending member 30 into the working region becomes smaller, and that more of the upper part of the first bending member 30 is supported by the bending member guide 520, so that strong and uniform force can be exerted on the engaging portion between the bending member 50 and the cutting blade A.

Now, The operation of the bending apparatus in accordance with the present invention will be described.

Firstly, the cutting blade A winding around the reel 12 of the cutting blade supply unit 10 is moved along the guide passage 210 of the guide 20, released from the guide head 220, and thus remains in a bending standby state.

The entire bending apparatus is operated by an automated control program by a computer. Initiated by a start signal, the first bending member 30 and the second bending member 40 that were withdrawn from the working region of the cutting blade A advance in a vertical direction by the operation of the actuators 100, 100, so as to protrude to about a half of the height of the guide 20, and face across each other by a predetermined gap. When the drive means 90 is driven under the control of the automated program, the driving force is simultaneously applied to the first rotary body 50 and the second rotary body 60 via belts 91, 91, thereby rotating the rotary bodies 50, 60. The first bending member 30 and the second bending member 40 eccentrically supported by the holes 521, 621 of the rotary bodies 50, 60 are rotated to engage with and exert lateral force to the cutting blade A. In order to bend the other side of the cutting blade A, the bending members 30, 40 are fully withdrawn into the bending member guides 520, 620 driven by the actuators 100, 100. The rotary bodies 50, 60 are rotated until they are positioned at the opposite side of the cutting blade A, and the bending members 30, 40 are protruded again.

The operation of the bending apparatus in accordance with the present invention will now be described in more detail with reference to FIGS. 7, 8 and 11.

When there is no spring back, relative lengthwise positions of the first bending member 30 and the second bending member 40 are identical.

Figure 7:
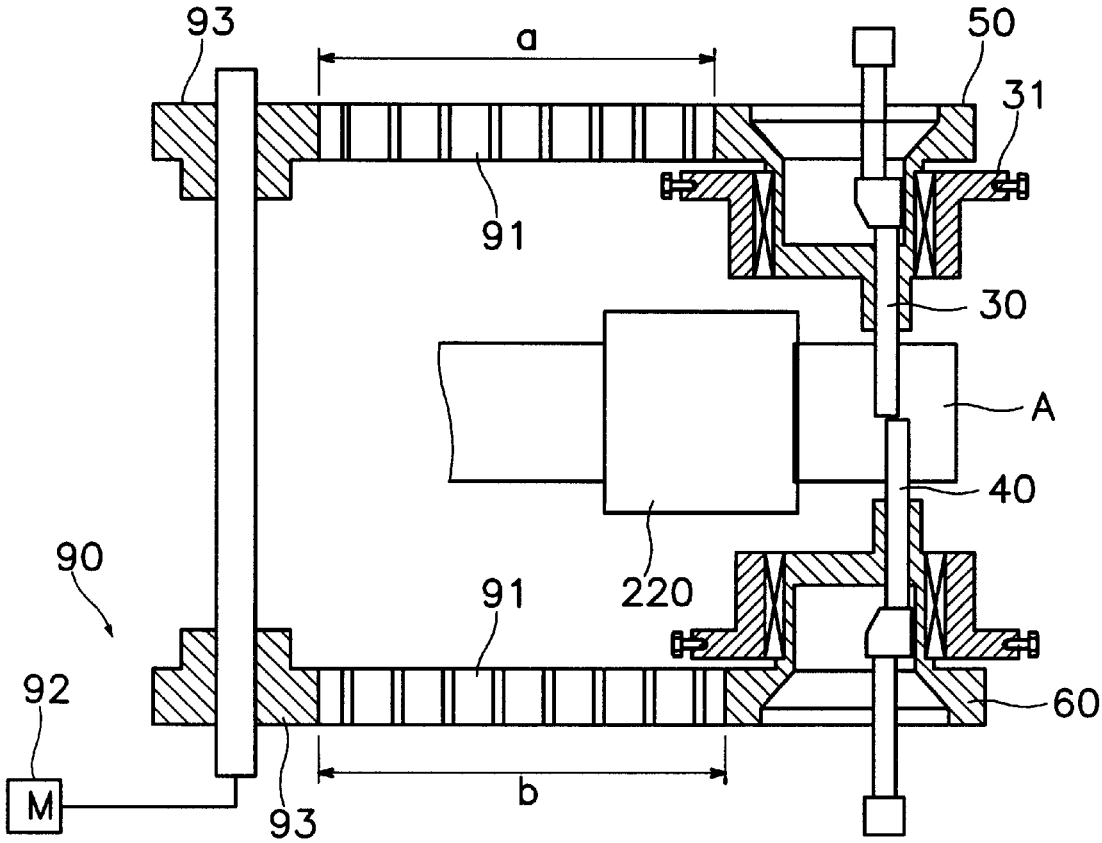
FIG. 7 is a cross-sectional view illustrating the bending process in a state where a relative position of the bending member has been changed in accordance with the present invention.
Figure 8:
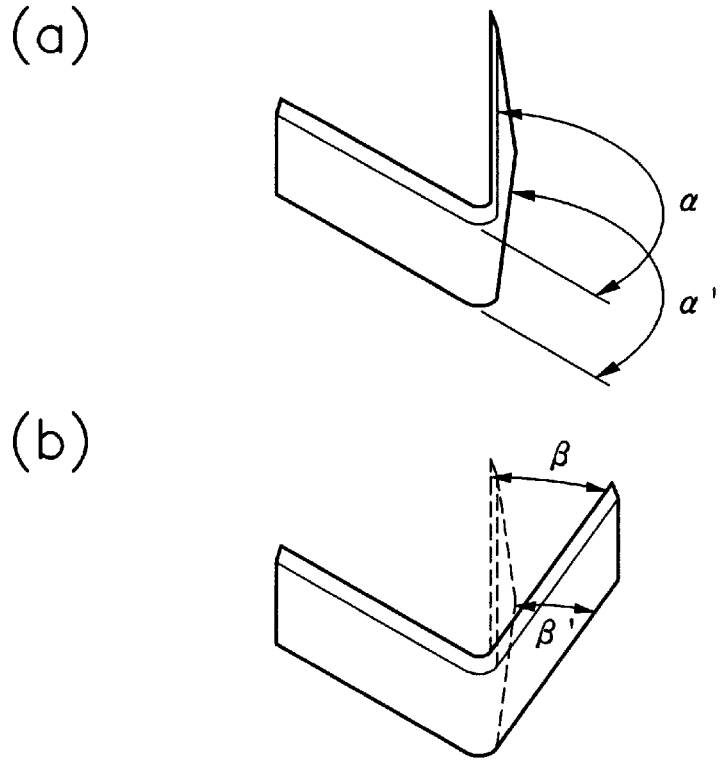
FIGS. 8(*a*) and 8(*b*) are perspective views illustrating the bending state of the cutting blade by the bending apparatus in accordance with the present invention.
Figure 9:
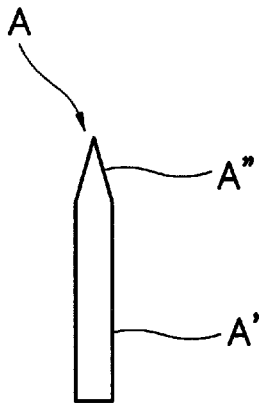
FIG. 9 is a side view illustrating the cutting blade.

However, in the case that the cutting blade A is distorted or deformed due to spring back, the bending process is performed after slightly moving the first movable setting means 31 so that the first rotary body 50 and the first bending member 30 can be positioned more adjacently to the guide head 220 than the second bending member 40, which state is illustrated in FIG. 7. Of course, the same procedure can be performed by moving the second rotary body 60 to the right side. In either case, the linear distance (a) from the first rotary body 50 to the pulley 93 of the drive means 90 is smaller than the linear distance (b) from the second rotary body 60 to the pulley 93. Accordingly, the first rotary body 50 is rotated more than the second rotary body 60, and the net rotated angle of the first bending member 30 is greater than that of the second bending member 40. Therefore, as illustrated in FIGS. 8(*a*) and 8(*b*), the upper portion of the cutting blade A contacted with the first bending member 30 has a greater horizontal bending angle than the lower portion of the cutting blade A contacted with the second bending member 40 ($\alpha>\alpha'$). However, when spring back takes place, a restoring force, thus a returning or spring back angle of the upper portion is greater than that of the lower portion ($\beta>\beta'$). The former difference can be entirely offset by the latter difference ($\alpha-\alpha'=\beta-\beta'$). Thus made cutting blade profile can provide precise vertical bending and uniform horizontal bending angle without deformation or distortion. It should be noted that the above-described advantage can be expected only when the bending members are separately divided into the upper and lower bending members 30, 40 to respectively receive independent driving force.

Bending process in accordance with above operation can be accurately carried out without error, if the movement distance is predetermined based upon external sizes of the cutting blade A, such as thickness and height. In this regard, the preferred embodiments of the present invention will now be described in detail with reference to FIG. 11.

Figure 11:
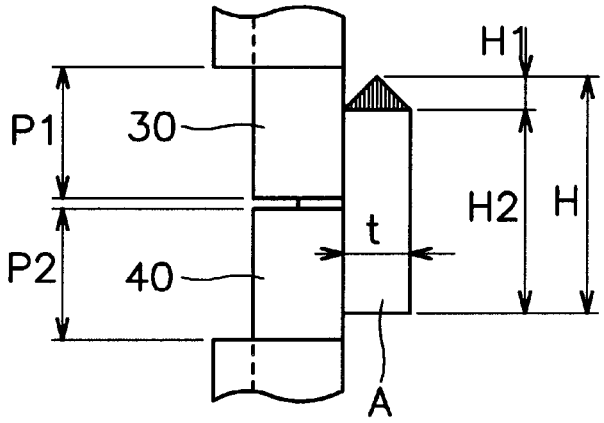
FIG. 11(*a*) is a generalized front view for explaining the bending operation of the present invention.
Figure 11:
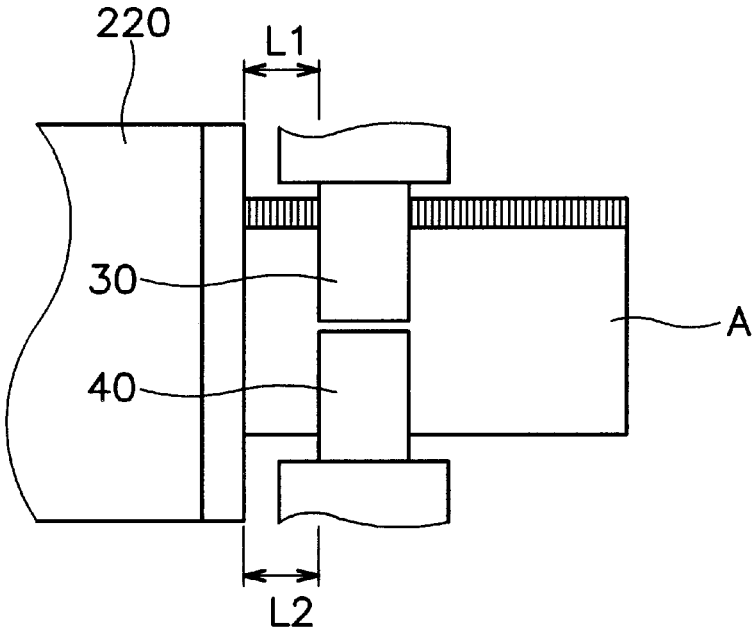
Figure 12:
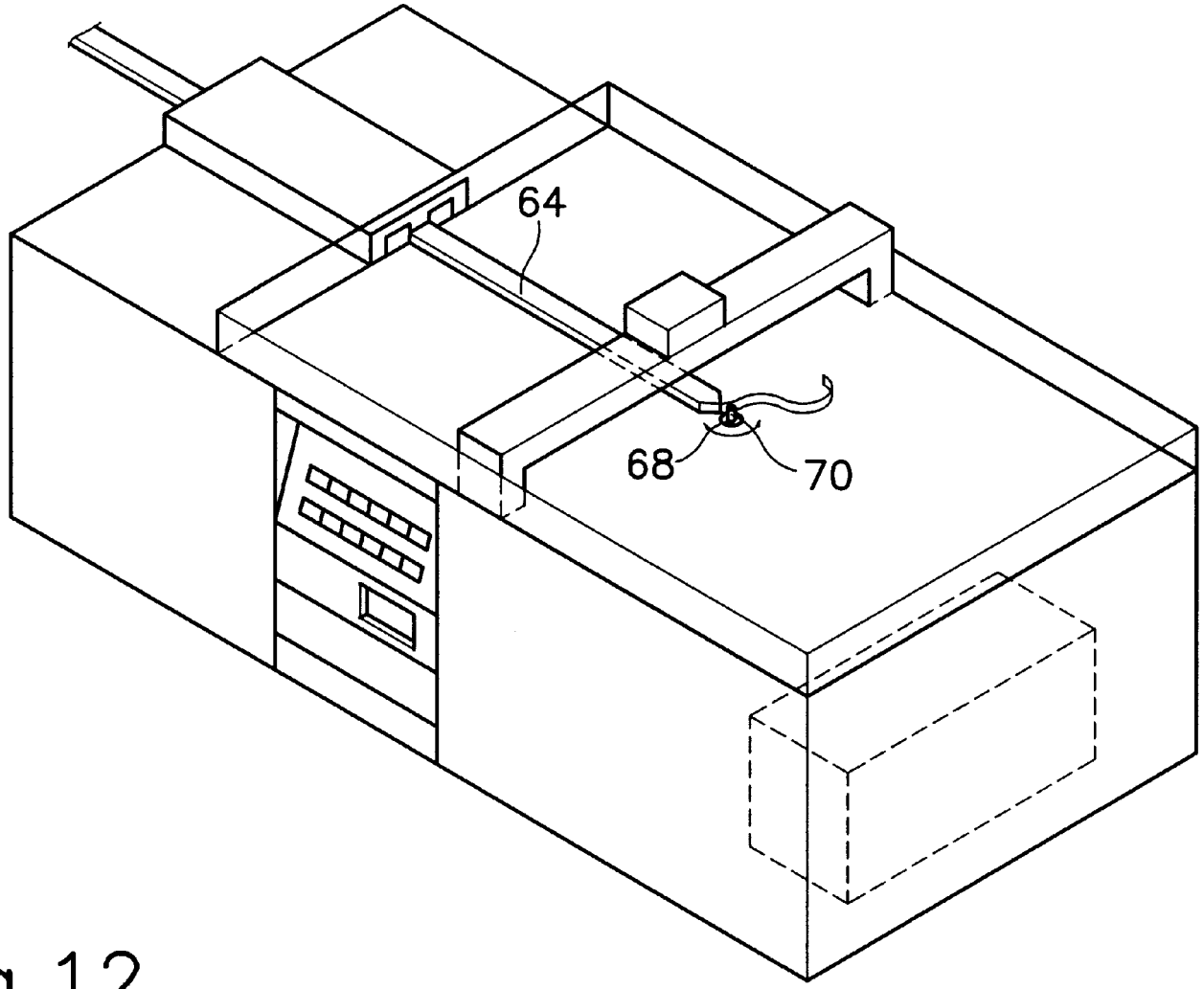
FIG. 12 is a perspective view illustrating a conventional bending apparatus.

FIGS. 11(*a*) and 11(*b*) are a front view and a side view respectively illustrating the state where the two bending members 30, 40 are contacted with the cutting blade A. P1 and P2 respectively denote exposed vertical lengths of the first and second bending members 30, 40, H1 denotes a height of the blade portion of the cutting blade A, H2 denotes a height of the body portion, and t denotes a thickness of the cutting blade A. In addition, L1 and L2 respectively denote distances from the cutting blade exit of the guide head 220 to each bending member 30, 40. Table 1 shows adjusted relative positions (L2−L1) of the first bending member 30 to the second bending member 40 corresponding to various external sizes of the cutting blade A for forming accurate vertical profile and horizontal bending angle.

TABLE 1

| Sizes | | Embodiment 1 | Embodiment 2 | Embodiment 3 | Embodiment 4 |
|---|---|---|---|---|---|
| Cutting blade | H1 | 0.7 | 2.4 | 0.7 | 0.5 |
| | H2 | 23.1 | 21.4 | 31.3 | 11.5 |
| | T | 0.71 | 1.05 | 0.71 | 0.45 |
| Bending member | P1 | 13 | 15 | 18 | 7.5 |
| | P2 | 12 | 10 | 16 | 6.5 |
| Guide exit bending members | L1 | 1.48 | 2.27 | 1.48 | 0.7 |
| | L2 | 1.5 | 2.3 | 1.5 | 0.7 |
| L2-L1 | | 0.02 | 0.03 | 0.02 | 0 |

(unit : mm)

It is noted that the first bending member 30 should be more adjacently positioned to the guide 20 than the second bending member 40 in order to prevent spring back drawbacks and form an accurate profile of the cutting blade A. In addition, it is noted from the comparison between embodiments 1 and 3, if the cutting blade A of small height is to be bent, exposed lengths of the bending members 30, 40 from the bending member guides 520, 620 are preferably adjusted to be as small as possible to exert large and uniform force. Further, it is noted that in some cases, all positions of the first and second bending members 30, 40 are preferably changed in a lengthwise direction toward the guide for effecting accurate bending, with the resultant value of (L2−L1) being kept. In Embodiment 4, the height H2 and thickness t of the cutting blade A are small enough to ignore spring back and thus no gap in a lengthwise direction between bending members 30, 40 is necessary.

The bending apparatus of the present invention has the following peculiar advantages:

(1) According to the present invention, since it is possible to adjust relative positions of the first and the second bending members in a lengthwise and/or vertical direction, independent forces can be applied to each upper and lower portions of the cutting blade, which forces are adjusted based upon predetermined sizes of the cutting blade such as height and thickness and in particular physical property thereof, thereby eliminating or minimizing drawbacks caused by spring back effects and forming the cutting blade into desirable precise profiles.

(2) It is also possible to bend cutting blades of various heights with a single apparatus by changing the bending member guide, requiring no alteration or change of the bending member as well as the entire machine. Thus, merits of high productivity and low cost are expected.

What is claimed is:

1. An apparatus for bending a cutting blade rule, comprising:

a guide having a guide passage formed therein for transferring said cutting blade rule in a lengthwise direction;

a first rotary body located at an upper position adjacent to a head of said guide;

a second rotary body located at a lower position adjacent to the head of said guide and oppositely to said upper position;

a first bending member extending through a hole formed in said first rotary body;

a second bending member supported by a hole formed on said second rotary body, said second bending member being opposite to said first bending member in an end-to-end relationship in a substantial perpendicular direction to said lengthwise direction;

a drive means for driving said first and second rotary bodies; and linear drive means for linearly moving said first and second bending members respectively.

2. The apparatus of claim 1, wherein said first bending member is spaced by a distance from said second bending member in said lengthwise direction towards said guide.

3. The apparatus of claim 1, wherein said apparatus further comprises a movable setting means for moving said first rotary body and thus said first bending member in said lengthwise direction.

4. The apparatus of claim 1, wherein said apparatus further comprises a movable setting means for moving said second rotary body and thus said second bending member in said lengthwise direction.

5. The apparatus of claim 3 or 4, wherein each movable setting means accommodates said first rotary body and said second rotary body respectively, and is moved by a distance in said lengthwise direction by adjusting distance adjusting bolts affixed to lateral sides thereof.

6. The apparatus of one of claims 1–4, wherein said first rotary body and said second rotary body are connected to said drive means via belts.

7. The apparatus of claim 1, wherein the length of said first and/or second bending members engaging with said cutting blade can be adjusted in said perpendicular direction.

8. The apparatus of claim 1, wherein said first rotary body and/or said second rotary body comprise(s):

an upper radial portion which is directly connected to said drive means via said belt;

a lower radial portion integrally formed with and protruding from said upper radial portion; and a bending member guide having said hole formed therein, and protruding outwards from said lower radial portion.

9. The apparatus of claim 8, wherein said bending member guide is exchangeable.

10. The apparatus of claim 8 or 9, wherein said bending member guide is fixed to a holder that is again fixed to said lower radial portion of said first and/or second rotary body.

11. An apparatus for bending a cutting blade, comprising:

a guide having a guide passage formed therein that is configured to accommodate transferring said cutting blade in a lengthwise direction through the guide passage;

a first rotary body located at an upper position adjacent to a head of said guide;

a second rotary body located at a lower position adjacent to the head of said guide and oppositely to said upper position;

a first bending member extending through a hole formed in said first rotary body;

a second bending member extending from a hole formed on said second rotary body, said second bending member being opposite to said first bending member in an end-to-end relationship in a substantial perpendicular direction to said lengthwise direction;

a driver arranged to drive said first and second rotary bodies; and a linear driver arranged to linearly move said first and second bending members respectively.

12. An apparatus as in claim 11, wherein said first and second bending members are spaced from the head of the guide by respective distances that differ from each other.

13. A method of bending a cutting blade rule, comprising:

supplying a cutting blade rule in a lengthwise direction through a guide passage of a guide to reach a position between first and second rotary bodies that are spaced from each other;

linearly moving first and second bending members that are in opposition to each other in an end-to-end relationship from a withdrawn position to a protruding position from respective ones with the first and second rotary bodies; and rotatably driving the first and second rotary bodies to move respective ones of the first and second bending members into bending engagement with the cutting blade rule that is at the position between the first and second rotary bodies.

14. A method as in claim 13, further comprising moving the first rotary body and the first bending member in the lengthwise direction.

15. A method as in claim 13, further comprising moving the second rotary body and the second rotary member in the lengthwise direction.

16. An apparatus for bending a cutting blade rule, comprising:

a guide that defines an elongated passage;

two spaced apart rotary bodies;

two bending members that face opposite each other in an end-to-end relationship, each of the two bending members having withdrawn and protruding positions from respective ones of the two spaced apart rotary bodies, the two bending members facing opposite each other and movable towards and away from each other;

a rotation driver arranged to rotatably drive said first and second rotary bodies to effect rotation;

a linear driver arranged to linearly move said first and second bending members respectively towards and away from each other; and a supplier arranged to supply cutting blade rule through the elongated passage to reach a position between said two spaced apart rotary bodies.

17. An apparatus as in claim 16, wherein said first and second bending members move in directions that are transverse to a direction of elongation of the elongated passage.

18. An apparatus as in claim 16, wherein the bending members are spaced from a head of the guide by respective distances that differ from each other.

* * * * *

UNITED STATES PATENT AND TRADEMARK OFFICE

CERTIFICATE OF CORRECTION

PATENT NO. : 6,308,551 B1
DATED : October 30, 2001
INVENTOR(S) : Hong Soon Park

It is certified that error appears in the above-identified patent and that said Letters Patent is hereby corrected as shown below:

Column 10,
Line 24, change “from” to -- with --; and change “with” to -- of --.

Signed and Sealed this

First Day of April, 2003

JAMES E. ROGAN
*Director of the United States Patent and Trademark Office*